US007053872B2

(12) United States Patent
Iwami

(10) Patent No.: US 7,053,872 B2
(45) Date of Patent: May 30, 2006

(54) DISPLAY PANEL DRIVING METHOD

(75) Inventor: Takashi Iwami, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 2 days.

(21) Appl. No.: 10/801,638

(22) Filed: Mar. 17, 2004

(65) Prior Publication Data

US 2004/0233129 A1 Nov. 25, 2004

(30) Foreign Application Priority Data

Apr. 18, 2003 (JP) ..... 2003-113651
Jun. 25, 2003 (JP) ..... 2003-180709

(51) Int. Cl.
*G09G 3/28* (2006.01)

(52) U.S. Cl. ..... 345/60; 345/62; 345/63; 345/66

(58) Field of Classification Search ..... 345/60–72
See application file for complete search history.

(56) References Cited

U.S. PATENT DOCUMENTS 6,326,736 B1 * 12/2001 Kang et al. ..... 315/169.4
2003/0197661 A1 * 10/2003 Choi ..... 345/60

* cited by examiner

*Primary Examiner*—Dennis-Doon Chow
(74) *Attorney, Agent, or Firm*—Sughrue Mion, PLLC

(57) ABSTRACT

A display panel driving apparatus capable of displaying images of good quality with a limited dither pattern. Each of pixel cells arranged on each display line in a plurality of adjacent display lines is forced to emit light at a different luminance level based on a weighting coefficient assigned to each of the display lines, wherein a weighting coefficient is assigned to each of the display lines such that an offset of luminance difference between pixel cells arranged on each of display lines adjacent to each other is held within a predetermined range across all the adjacent display lines in the display panel.

3 Claims, 13 Drawing Sheets

FIG. 6

| GRADATION LEVEL | CONVERSION TABLE FOR SECOND DATA CONVERTER CIRCUIT 34 | | | | | | | | | | | | | LIGHT EMISSION DRIVING PATTERN FOR ONE FIELD | | | | | | | | | | | | LUMINANCE |
|---|---|---|---|---|---|---|---|---|---|---|---|---|---|---|---|---|---|---|---|---|---|---|---|---|---|---|
| | PDs | GD | | | | | | | | | | | | SF | SF | SF | SF | SF | SF | SF | SF | SF | SF | SF | SF | |
| | | 1 | 2 | 3 | 4 | 5 | 6 | 7 | 8 | 9 | 10 | 11 | 12 | 1 | 2 | 3 | 4 | 5 | 6 | 7 | 8 | 9 | 10 | 11 | 12 | |
| 1 | 0000 | 1 | 0 | 0 | 0 | 0 | 0 | 0 | 0 | 0 | 0 | 0 | 0 | ● | | | | | | | | | | | | 0 |
| 2 | 0001 | 0 | 1 | 0 | 0 | 0 | 0 | 0 | 0 | 0 | 0 | 0 | 0 | ○ | ● | | | | | | | | | | | 1 |
| 3 | 0010 | 0 | 0 | 1 | 0 | 0 | 0 | 0 | 0 | 0 | 0 | 0 | 0 | ○ | ○ | ● | | | | | | | | | | 3 |
| 4 | 0011 | 0 | 0 | 0 | 1 | 0 | 0 | 0 | 0 | 0 | 0 | 0 | 0 | ○ | ○ | ○ | ● | | | | | | | | | 7 |
| 5 | 0100 | 0 | 0 | 0 | 0 | 1 | 0 | 0 | 0 | 0 | 0 | 0 | 0 | ○ | ○ | ○ | ○ | ● | | | | | | | | 13 |
| 6 | 0101 | 0 | 0 | 0 | 0 | 0 | 1 | 0 | 0 | 0 | 0 | 0 | 0 | ○ | ○ | ○ | ○ | ○ | ● | | | | | | | 23 |
| 7 | 0110 | 0 | 0 | 0 | 0 | 0 | 0 | 1 | 0 | 0 | 0 | 0 | 0 | ○ | ○ | ○ | ○ | ○ | ○ | ● | | | | | | 37 |
| 8 | 0111 | 0 | 0 | 0 | 0 | 0 | 0 | 0 | 1 | 0 | 0 | 0 | 0 | ○ | ○ | ○ | ○ | ○ | ○ | ○ | ● | | | | | 56 |
| 9 | 1000 | 0 | 0 | 0 | 0 | 0 | 0 | 0 | 0 | 1 | 0 | 0 | 0 | ○ | ○ | ○ | ○ | ○ | ○ | ○ | ○ | ● | | | | 81 |
| 10 | 1001 | 0 | 0 | 0 | 0 | 0 | 0 | 0 | 0 | 0 | 1 | 0 | 0 | ○ | ○ | ○ | ○ | ○ | ○ | ○ | ○ | ○ | ● | | | 112 |
| 11 | 1010 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ● | | 151 |
| 12 | 1011 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ● | 198 |
| 13 | 1100 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | 255 |

BLACK CIRCLE: SELECTIVE ERASURE DISCHARGE
WHITE CIRCLE: SUSTAIN DISCHARGE LIGHT EMISSION

FIG. 10

| | $D_1$ | $D_2$ | $D_3$ | $D_4$ | $D_5$ | ··· | $D_{(m-2)}$ | $D_{(m-1)}$ | $D_m$ |
|---|---|---|---|---|---|---|---|---|---|
| FIRST DISPLAY LINE | ○ | ○ | ○ | ○ | ○ | | ○ | ○ | ○ |
| SECOND DISPLAY LINE | ● | ● | ● | ● | ● | | ● | ● | ● |
| THIRD DISPLAY LINE | ○ | ○ | ○ | ○ | ○ | | ○ | ○ | ○ |
| FOURTH DISPLAY LINE | ● | ● | ● | ● | ● | | ● | ● | ● |
| FIFTH DISPLAY LINE | ○ | ○ | ○ | ○ | ○ | | ○ | ○ | ○ |
| SIXTH DISPLAY LINE | ● | ● | ● | ● | ● | | ● | ● | ● |
| SEVENTH DISPLAY LINE | ○ | ○ | ○ | ○ | ○ | | ○ | ○ | ○ |
| EIGHTH DISPLAY LINE | ● | ● | ● | ● | ● | | ● | ● | ● |
| NINTH DISPLAY LINE | ○ | ○ | ○ | ○ | ○ | | ○ | ○ | ○ |
| ⋮ | | | ⋮ | | | | | ⋮ | |
| (n-3)TH DISPLAY LINE | ○ | ○ | ○ | ○ | ○ | | ○ | ○ | ○ |
| (n-2)TH DISPLAY LINE | ● | ● | ● | ● | ● | | ● | ● | ● |
| (n-1)TH DISPLAY LINE | ○ | ○ | ○ | ○ | ○ | | ○ | ○ | ○ |
| n-TH DISPLAY LINE | ● | ● | ● | ● | ● | | ● | ● | ● |

○: LIGHT EMISSION MODE

●: LIGHT EXTINCTION MODE

FIG. 11

| | $D_1$ | $D_2$ | $D_3$ | $D_4$ | $D_5$ | ··· | $D_{(m-2)}$ | $D_{(m-1)}$ | $D_m$ |
|---|---|---|---|---|---|---|---|---|---|
| FIRST DISPLAY LINE | ○ | ○ | ○ | ○ | ○ | | ○ | ○ | ○ |
| SECOND DISPLAY LINE | ○ | ○ | ○ | ○ | ○ | | ○ | ○ | ○ |
| THIRD DISPLAY LINE | ● | ● | ● | ● | ● | | ● | ● | ● |
| FOURTH DISPLAY LINE | ● | ● | ● | ● | ● | | ● | ● | ● |
| FIFTH DISPLAY LINE | ○ | ○ | ○ | ○ | ○ | | ○ | ○ | ○ |
| SIXTH DISPLAY LINE | ○ | ○ | ○ | ○ | ○ | | ○ | ○ | ○ |
| SEVENTH DISPLAY LINE | ● | ● | ● | ● | ● | | ● | ● | ● |
| EIGHTH DISPLAY LINE | ● | ● | ● | ● | ● | | ● | ● | ● |
| NINTH DISPLAY LINE | ○ | ○ | ○ | ○ | ○ | | ○ | ○ | ○ |
| ⋮ | | | ⋮ | | | | | ⋮ | |
| (n-3)TH DISPLAY LINE | ○ | ○ | ○ | ○ | ○ | | ○ | ○ | ○ |
| (n-2)TH DISPLAY LINE | ● | ● | ● | ● | ● | | ● | ● | ● |
| (n-1)TH DISPLAY LINE | ● | ● | ● | ● | ● | | ● | ● | ● |
| n-TH DISPLAY LINE | ○ | ○ | ○ | ○ | ○ | | ○ | ○ | ○ |

○: LIGHT EMISSION MODE

●: LIGHT EXTINCTION MODE

DISPLAY PANEL DRIVING METHOD

BACKGROUND OF THE INVENTION

1. Field of the Invention

The present invention relates to a driving method for driving a display panel such as an AC driven plasma display panel or an electroluminescence display panel.

2. Description of the Related Art

Currently, display panels comparing capacitive light emitting elements such as a plasma display panel (hereinafter referred to as the "PDP"), an electroluminescence display panel (hereinafter referred to as the "ELP") and the like have been brought into practical use to provide wall-mounted television sets.

FIG. 1 generally shows such a plasma display panel which has a PDP as a display panel (see, for example, Japanese Patent Kokai No. 2002-156941).

In FIG. 1, a PDP 10 as a plasma display panel comprises row electrodes $Y_1$–$Y_n$ and $X_1$–$X_n$ which form pairs of row electrodes X, Y, each of which corresponds to each line (first to n-th rows) of one screen. The PDP 10 is further formed of column electrodes $Z_1$–$Z_m$ corresponding to respective columns (first to m-th columns) of one screen, which are orthogonal to the row electrode pairs and across a dielectric layer and a discharge space, not shown. A discharge cell serving as a pixel is formed at the intersection of a pair of row electrodes (X, Y) with a column electrode Z.

Here, since each discharge cell emits light by discharging, it has only two states: a light emitting state at the highest luminance and an unlit state. In other words, the discharge cell can represent only two levels of luminance, i.e., the lowest luminance and highest luminance if no measures are taken therefor.

Thus, a driving apparatus 100 conducts a gradation driving scheme which employs a sub-field method for providing halftone luminance levels corresponding to an input video signal for the PDP 10 which is comprised of such a light emitting element as each pixel cell.

The sub-field method involves converting an input video signal into N-bit pixel data corresponding to each pixel, and dividing one field display period into N sub-fields corresponding to respective bit digits of the N bits. Each of the sub-fields is assigned the number of times of discharge generated corresponding to a weighting coefficient applied to the sub-field, so that this discharge is selectively generated only in sub-fields in accordance with the video signal. In this event, a halftone luminance corresponding to the video signal can be accomplished by a total number of times the discharge is generated in each sub-field (within one field display period).

A selective erasure addressing method is known as a method of driving a PDP to provide halftone luminance by use of the sub-field method.

FIG. 2 is a timing chart showing applying timings at which the driving apparatus 100 applies a variety of driving pulses to the column electrodes and the row electrode pairs of the PDP 10 in one sub-field based on the selective erasure addressing method (see, for example, FIG. 2 in Japanese Patent Kokai No. 2002-156941).

The driving apparatus 100 first applies a reset pulse $RP_X$ of negative polarity to the row electrodes $X_1$–$X_n$, and a reset pulse $RP_Y$ of positive polarity to the row electrodes $Y_1$–$Y_n$ (simultaneous reset stage Rc). In response to the application of these reset pulses $RP_X$ and $RP_Y$, all the discharge cells in the PDP 10 are reset or discharged to uniformly form a predetermined amount of wall charge in each of the discharge cells. In this way, all the discharge cells are initially set once into a light emission mode.

Next, the driving apparatus 100 converts the input video signal, for example, into 8-bit pixel data for each pixel. The driving apparatus 100 divides the pixel data for each bit digit to generate pixel data bits, and generates a pixel data pulse having a pulse voltage in accordance with the logical level of each of the pixel data bits. For example, the driving apparatus 100 generates the pixel data pulse DP at a high voltage when the pixel data bit is at logical level "1" and at a low voltage (zero volt) when the pixel data bit is at logical level "0." Then, the driving apparatus 100 sequentially applies the column electrodes $Z_1$–$Z_m$ with the pixel data pulses DP for one line (m pulses). Further, the driving apparatus 100 sequentially applies the row electrodes $Y_1$–$Y_n$ with a scanning pulse SP as shown in FIG. 2 in synchronism with the timings of applying the pixel data pulses DP (pixel data writing stage Wc). In this event, a discharge occurs only in discharge cells at intersections of those row electrodes which have been applied with the scanning pulse SP and those column electrodes which have been applied with the pixel data pulses at high voltage (selective writing discharge) to erase wall charges remaining in these discharge cells. In this way, those discharge cells, which have been initialized to the light emission mode in the simultaneous reset stage Rc, proceed to a light extinction mode. On the other hand, those discharge cells which have been applied with the scanning pulse SP but also applied with low voltage image data pulses do not undergo the selective writing discharge, and remain in the initialized state in the simultaneous reset stage Rc, i.e., the light emission mode.

Next, as shown in FIG. 2, the driving apparatus 100 repeatedly applies a sustain pulse $IP_X$ of positive polarity to the row electrodes $X_1$–$X_n$ and repeatedly applies a sustain pulse $IP_Y$ of positive polarity to the row electrodes $Y_1$–$Y_n$ (light emission sustaining stage Ic). In this event, those discharge cells in which the wall charge remains, i.e., only discharge cells in the light emission mode discharge each time they are alternately applied with the sustain pulses $IP_X$, $IP_Y$ (sustain discharge). In other words, only discharge cells which have been set into the light emission mode in the pixel data writing stage Wc repeat the light emission associated with the sustain discharge a number of times corresponding to the weight coefficient applied to each sub-field to sustain their light emitting state. It should be noted that the number of times the sustain pulses $IP_X$, $IP_Y$ are applied in one sub-field has been previously set in accordance with the weighting coefficient applied to each sub-field.

Next, the driving apparatus 100 applies the row electrodes $X_1$–$X_n$ with an erasure pulse EP as shown in FIG. 2 (erasure stage E). In this way, all the discharge cells are simultaneously erased or discharged to extinguish the wall charges remaining in the respective discharge cells.

However, when the foregoing driving is applied to a capacitive display panel such as the PDP or ELP, the application of the pixel data pulse DP, for example, results in charging and discharging of not only display lines for which a data write is intended, but also display lines for which the data write is not intended, and the capacitance must further be charged and discharged between adjacent column electrodes.

Consequently, a problem arises in that large power consumption is accompanied with a pixel data write.

It is an object of the present invention to provide a display panel driving method which is capable of reducing the power consumption.

SUMMARY OF THE INVENTION

A display panel driving method according to a first aspect of the present invention drives a display panel formed with a plurality of pixel cells serving as pixels on each of n display lines every plural sub-fields which make up each field of an input video signal for providing a gradation display, wherein each of the sub-field includes an addressing stage for scanning each of pixel cells formed on each of the n display lines from one display line to another to set the pixel cells into either a light emission mode or a light extinction mode based on the input video signal, and a sustain stage for forcing only the pixel cells set in the light emission mode to emit light for a duration corresponding to said sub-field, and each of the n display lines is scanned in the addressing stage in each of the at least two sub-fields in each of the sub-fields in an order different from a scanning order in the addressing stage of each of the other sub-fields.

A display panel driving method according to a second aspect of the present invention drives a display panel formed with a plurality of pixel cells serving as pixels on each of n display lines in accordance with an input video signal for providing a gradation display. The method comprising the step of performing an addressing stage for scanning each of the pixel cells formed on each of the n display lines from one display line to another to set the pixel cell into a light emission mode or a light extinction mode based on the input video signal, and a sustain stage for forcing only the pixel cells set in the light emission mode to emit light for a duration corresponding to the sub-field, wherein each of the n display lines is scanned in the addressing stage in the field or in a field group comprised of a plurality of the fields in an order different from a scanning order in the addressing stage in other fields or other field groups.

BRIEF DESCRIPTION OF THE DRAWINGS

FIG. 6 is a diagram showing a data conversion table for a second data converter circuit 34 shown in FIG. 4 in correspondence to a light emission driving pattern;

FIG. 10 is a diagram showing an example of the state (light emission mode or light extinction mode) which is set for each cell based on an input video signal in an addressing stage of each sub-field;

FIG. 11 is a diagram showing another example of the state (light emission mode or light extinction mode) which is set for each cell based on an input video signal in the addressing stage of each sub-field;

DETAILED DESCRIPTION OF THE INVENTION

Figure 1:
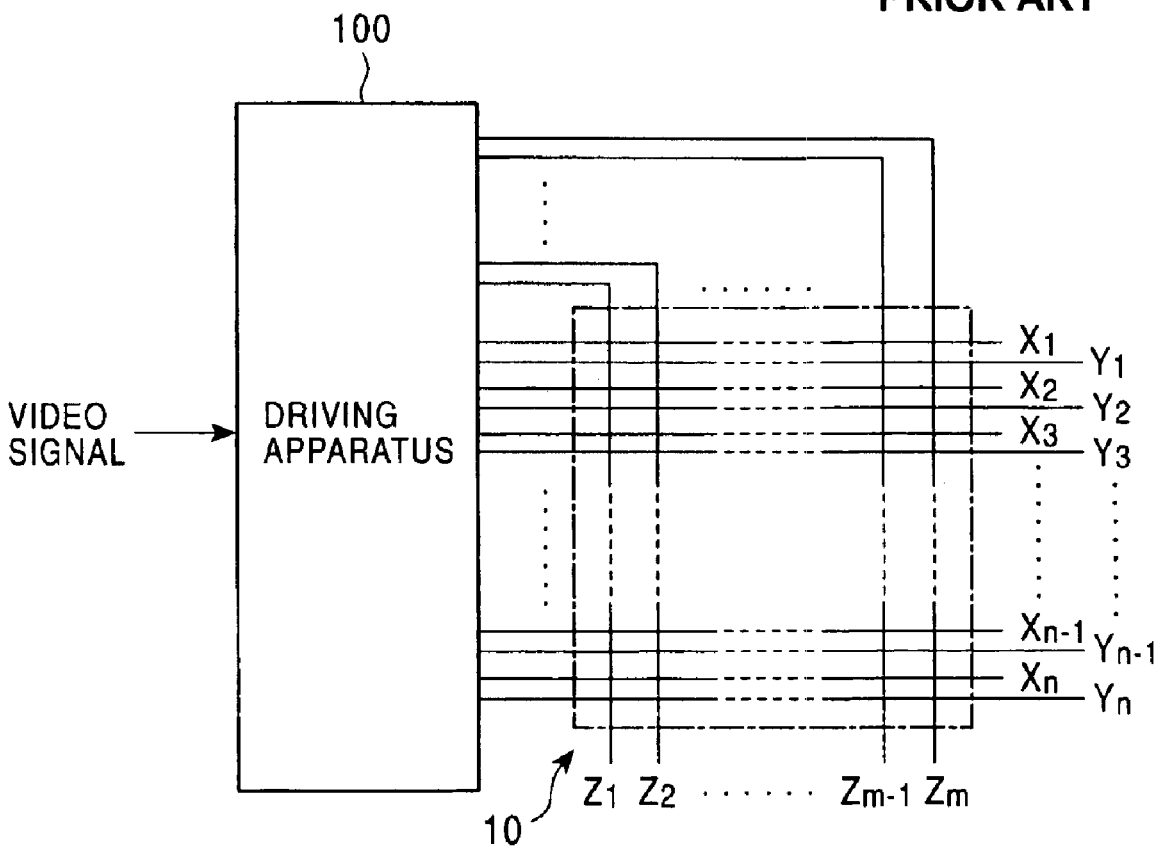
FIG. 1 PRIOR ART
FIG. 1 is a diagram generally showing the configuration of a plasma display device.
Figure 2:
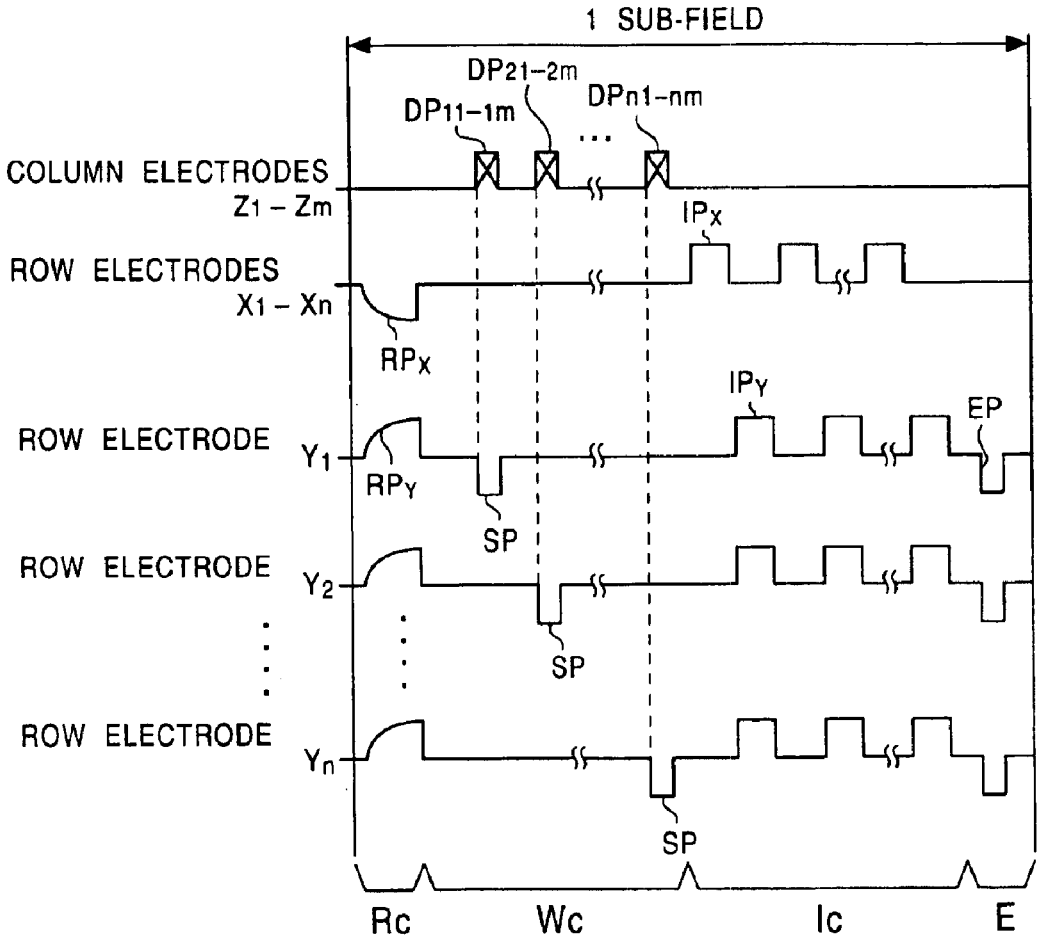
FIG. 2 PRIOR ART
FIG. 2 is a diagram showing a variety of driving pulses applied to the PDP 10 illustrated in FIG. 1 based on the sub-field method, and timings at which the driving pulses are applied.
Figure 3:
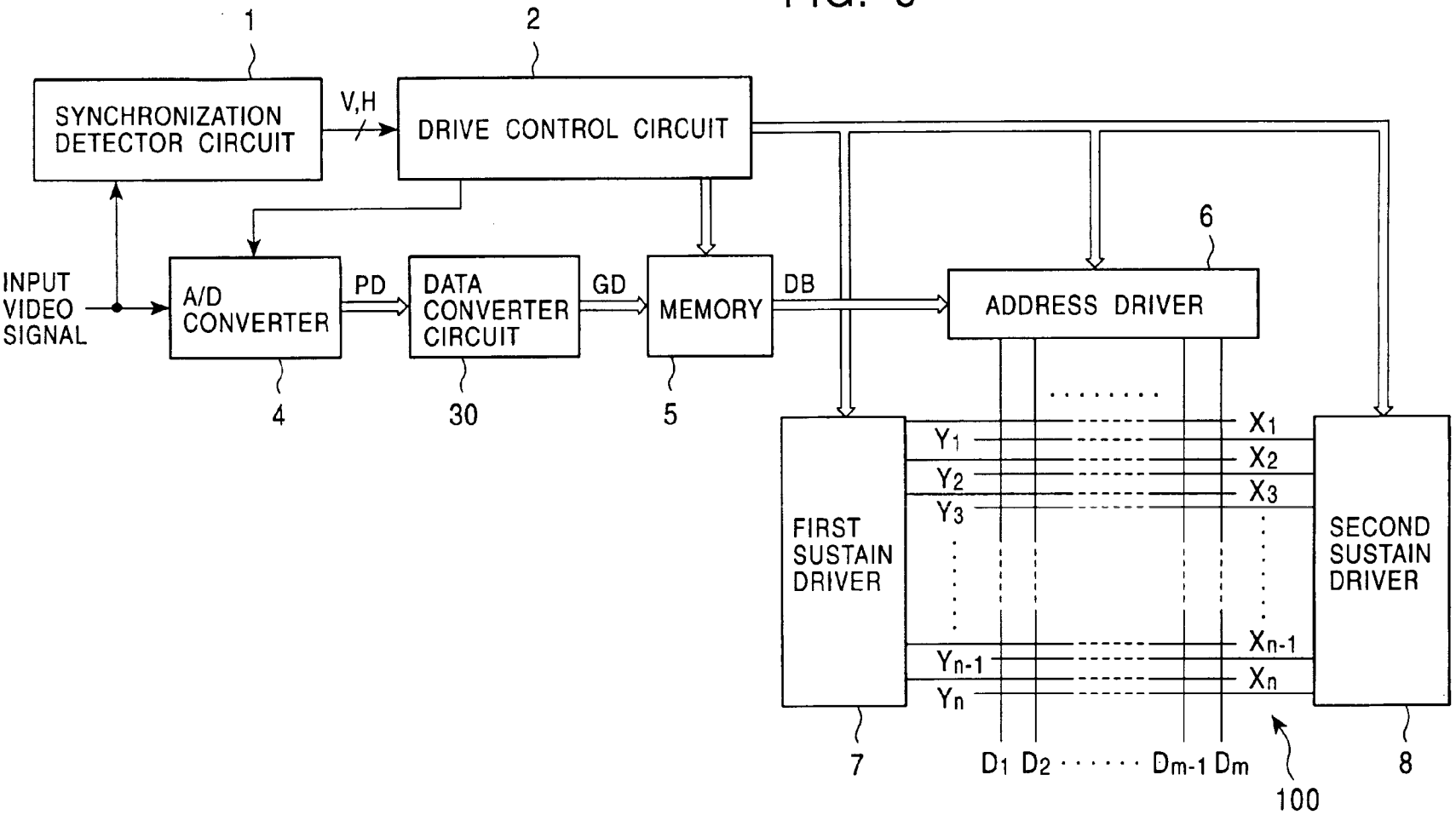
FIG. 3 is a diagram showing the configuration of a display device which employs a driving apparatus according to the present invention.

FIG. 3 is a diagram showing the configuration of a display device which drives a display panel in accordance with a driving method according to the present invention. The display device shown in FIG. 3 is made up of a plasma display panel 100 (hereinafter referred to as the "PDP 100") as the display panel, and a driving unit for driving the PDP 100. The driving unit comprises a synchronization detector circuit 1, a drive control circuit 2, an A/D converter 4, a data converter circuit 30, a memory 5, an address driver 6, a first sustain driver 7, and a second sustain driver 8.

The PDP 100 comprises m column electrodes $D_1$–$D_m$ as address electrodes, and n row electrodes $X_1$–$X_n$ and n row electrodes $Y_1$–$Y_n$ which are arranged to intersect with each of the column electrodes. A discharge cell serving as a pixel is formed at the intersection of each column electrode D and a pair of low electrodes X, Y adjacent to each other. In other words, PDP 100 is provided with a first to an n-th display line, each of which has m discharge cells arranged thereon.

The synchronization detector circuit 1 generates a vertical synchronization signal V when it detects a vertical synchronization signal from an analog input video signal, and generates a horizontal synchronization signal H when it detects a horizontal synchronization signal from this input video signal, and supplies these to the drive control circuit 2. The A/D converter 4 samples the analog input video signal in response to a clock signal supplied from the drive control circuit 2, and converts the sampled input video signal to, for example, 8-bit pixel data PD for each pixel which is supplied to the data converter circuit 30. In other words, the pixel data PD represents the luminance level of each pixel indicated by the input video signal by a value from "0" to "255."

Figure 4:
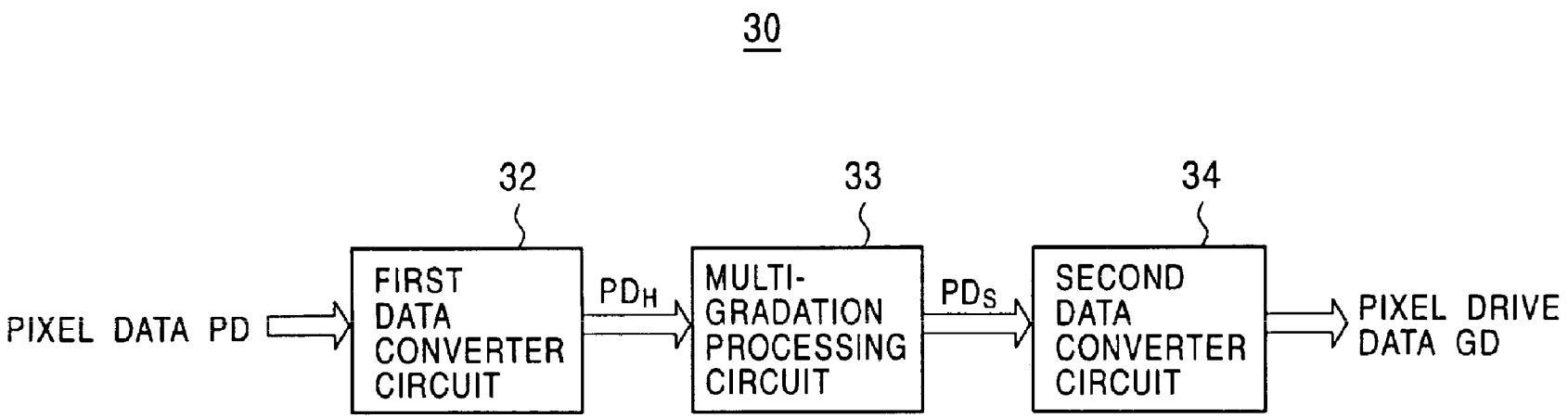
FIG. 4 is a diagram showing the internal configuration of a data converter circuit 30 shown in FIG. 3.

FIG. 4 is a diagram showing the internal configuration of the data converter circuit 30.

Figure 5:
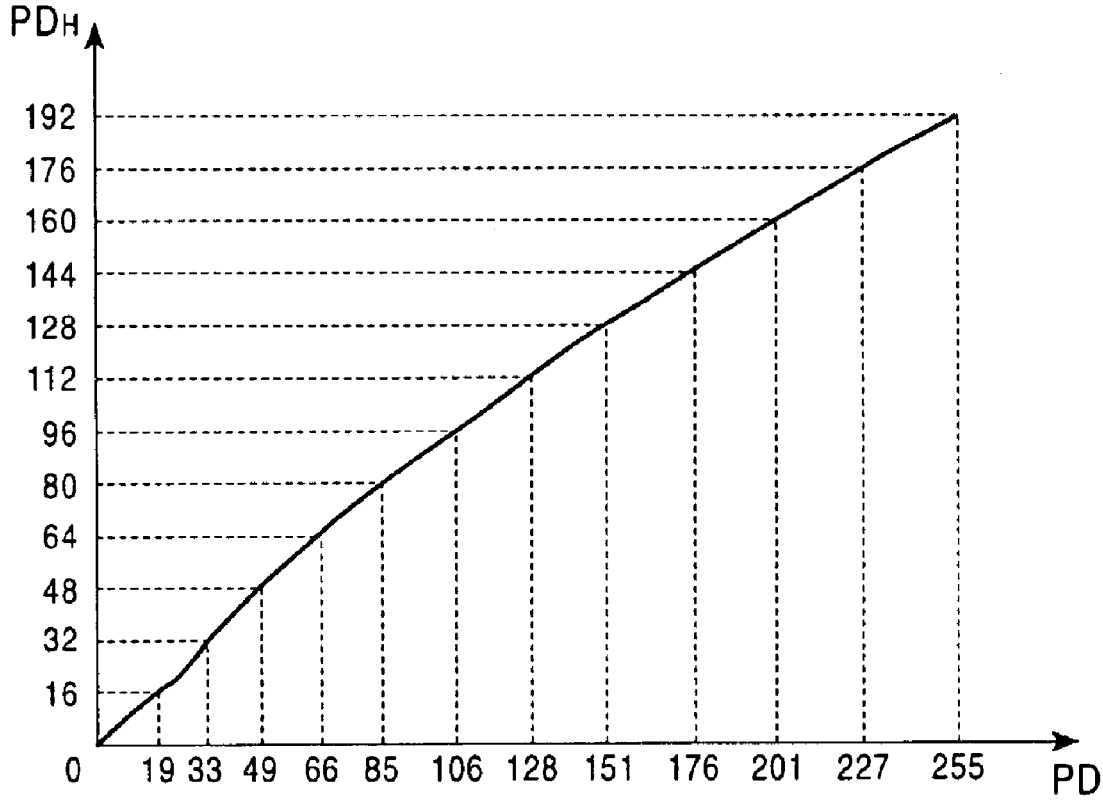
FIG. 5 is a diagram showing an example of conversion characteristic by a first data converter circuit 32 shown in FIG. 4.

As shown in FIG. 4, the data converter circuit 30 comprises a first data converter circuit 32, a multi-gradation processing circuit 33, and a second data converter circuit 34. In FIG. 4, the first data converter circuit 32 converts the luminance level of each pixel indicated by the 8-bit pixel data PD into luminance conversion pixel data $PD_L$ which represents the luminance level from "0" to "192" in eight bits in accordance with conversion characteristics as shown in FIG. 5, and supplies the luminance conversion pixel data $PD_L$ to the multi-gradation processing circuit 33. The data conversion performed by the first data converter circuit 32 prevents a saturated luminance caused by the multi-gradation processing in the multi-gradation processing circuit 33, and a flat portion (i.e., distortion in gradation) in the display characteristic which would be produced when a display gradation is not on a bit boundary.

The multi-gradation processing circuit 33 applies error diffusion processing and dither processing to the 8-bit luminance conversion pixel data $PD_L$ to generate multi-gradation pixel data $PD_S$ which has its number of bits compressed to four bits while maintaining the number of current gradation representation levels, and supplies the multi-gradation pixel data $PD_S$ to the second data converter circuit 34. For example, in the error diffusion processing, the pixel data PD is first separated into upper six bits regarded as display data and the remaining lower two bits regarded as error data. Then, the error data derived from the pixel data PD corresponding to respective peripheral pixels are added with weighting. The resulting data is reflected to the display data. This operation causes the luminance of the lower two bits in the original pixel to be virtually represented by the peripheral pixel, so that a luminance gradation representation equivalent to that provided by the 8-bit pixel data can be accomplished by the display data comprised of six bits which are less than eight bits. Next, the 6-bit error diffusion processed pixel data resulting from the error diffusion processing is applied with the dither processing. The dither processing involves treating a plurality of adjacent pixels as one pixel unit, and assigning dither coefficients having coefficient values different from one another to pixel data corresponding to the respective pixels in this pixel unit, and adding the resulting pixel data to derive dither addition pixel data. According to the dither addition as mentioned, a luminance corresponding to eight bits can be represented even with only the upper four bits of the dither addition pixel data, when viewed in the pixel unit. The multi-gradation processing circuit 33 extracts upper four bits of the dither addition pixel data as multi-gradation pixel data $PD_S$ which is supplied to the second data converter circuit 34.

The second data converter circuit 34 converts the 4-bit multi-gradation pixel data $PD_S$ to pixel drive data GD comprised of a first to a twelfth bit in accordance with a conversion table as shown in FIG. 6, and supplies the pixel drive data GD to the memory 5.

The pixel drive data GD is sequentially written into the memory 5 for storage in response to a write signal supplied from the drive control circuit 2. With the write operation, as pixel drive data $GD_{(1,1)}$–$GD_{(n,m)}$ has been completed for one screen (n lines, m columns), the memory 5 performs a read operation in response to a read signal supplied from the drive control circuit 2 in the following manner. Specifically, the memory 5 reads only the first bit of each of the pixel drive data $GD_{(1,1)}$–$GD_{(n,m)}$ as a pixel drive data bit DB1, and supplies the pixel drive data bits DB1 to the address driver 6 from one display line to another. Next, the memory 5 reads only the second bit of each of the pixel drive data $GD_{(1,1)}$–$GD_{(n,m)}$ as a pixel drive data bit DB2, and supplies the pixel drive data bits DB2 to the address driver 6 from one display line to another. Next, the memory 5 reads only the third bit of each of the pixel drive data $GD_{(1,1)}$–$GD_{(n,m)}$ as a pixel drive data bit DB3, and supplies the pixel drive data bits DB3 to the address driver 6 from one display line to another. In the following, the memory 5 similarly separates the fourth to the twelfth bits of each of the pixel drive data $GD_{(1,1)}$–$GD_{(n,m)}$ for reading as pixel drive data bits DB4,–DB12, and supplies each of the pixel drive data bits DB4–DB12 to the address driver 6 from one display line to another.

The memory 5 performs the read operation for each of the pixel drive data bits DB1–DB12 at the timing of each of sub-fields SF1–SF12, later described. Specifically, the memory 5 reads the pixel drive data bit DB1 in the sub-field SF1, and reads the pixel drive data bit DB2 in the sub-field SF2.

Figure 7:
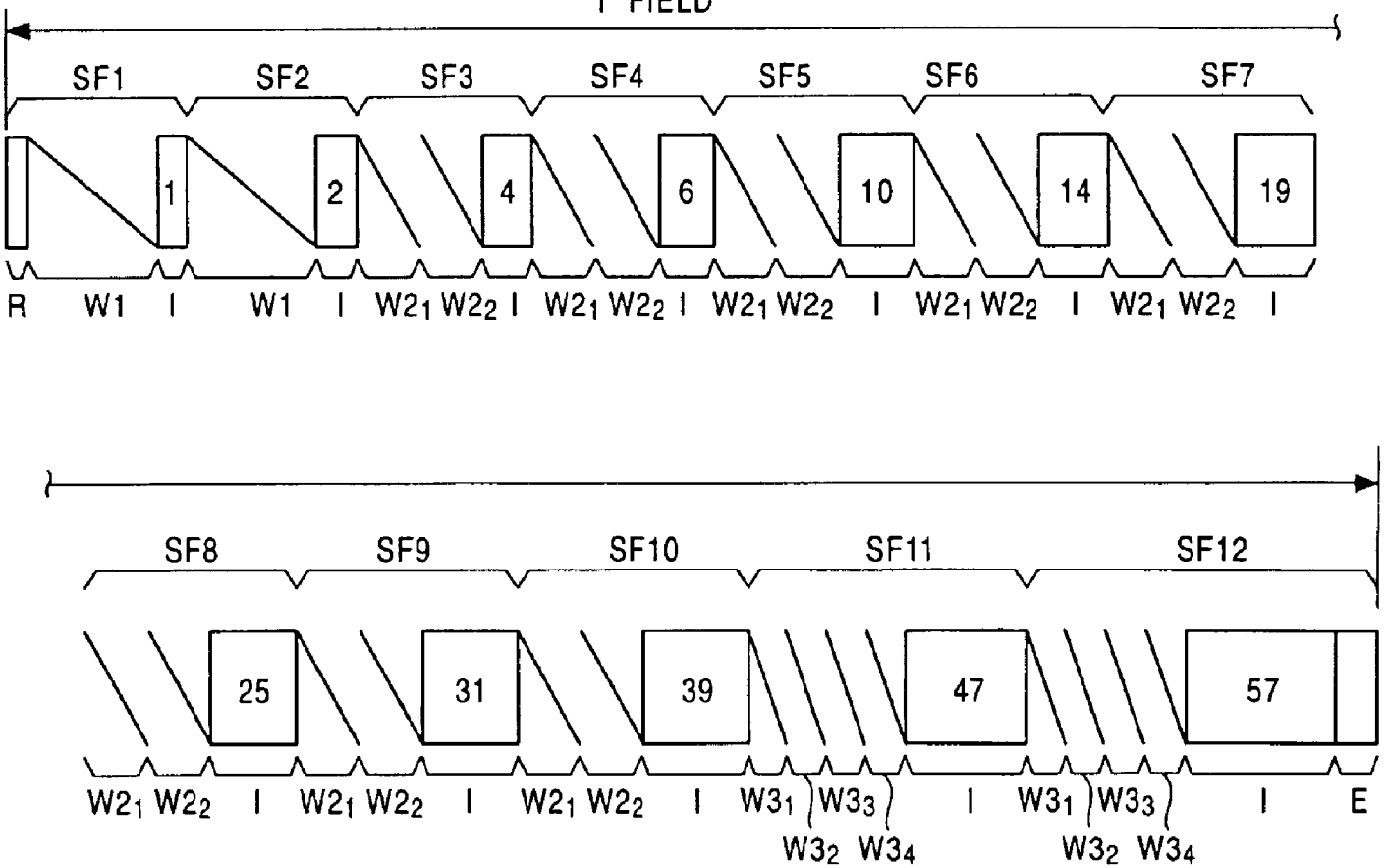
FIG. 7 is a diagram showing an example of light emission driving sequence in the display device shown in FIG. 3.

The drive control circuit 2 supplies a variety of timing signals for driving the PDP 100 to each of the address driver 6, first sustain driver 7, and second sustain driver 8 in accordance with a light emission driving sequence based on the sub-field method as shown in FIG. 7.

In the light emission driving sequence shown in FIG. 7, in each of the 12 sub-fields SF1–SF12, the addressing stage W (W1, $W2_1$–$W2_2$, $W3_1$–$W3_4$) is executed for setting each of the discharge cells into either the light emission mode or the light extinction mode in accordance with the pixel drive data bit DB. Further in each of the sub-fields SF1–SF12, a sustain stage I is executed for forcing only those discharge cells set in the light emission mode to continuously emit light for a duration corresponding to a weighting coefficient applied to each sub-field. For example, assuming that the duration of light emission performed in the sustain stage I of the sub-field SF1 is set to "1," discharge cells set in the light emission mode are forced to continuously emit light for the following durations in the sustain stage I of each of the sub-fields SF1–SF12:

SF1: 1
SF2: 2
SF3: 4
SF4: 6
SF5: 10
SF6: 14
SF7: 19
SF8: 25
SF9: 31
SF10: 39
SF11: 47
SF12: 57

Also, in the first sub-field SF1, the reset stage R is executed prior to the addressing stage to initialize all the discharge cells to the light emission mode. In the last sub-field SF12, the erasure stage E is executed after the sustain stage I for changing all the discharge cells to the light extinction mode.

In the addressing stage W1 in each of the sub-fields SF1 and SF2, each of the discharge cells belonging to each of the first to the n-th lines on the PDP 100 is sequentially set into the light emission mode or light extinction mode from one display line to another.

In the addressing stage $W2_1$ of each of the sub-fields SF3–SF10, only discharge cells belonging to each of odd-numbered display lines within the first to the n-th display lines on the PDP 100, i.e., the first, third, fifth, . . . , (n−1)th display lines are sequentially set into the light emission mode or light extinction mode from one display line to another. Also, in the addressing stage $W2_2$ of each of the sub-fields SF3–SF10, only discharge cells belonging to each of even-numbered display lines, i.e., the second, fourth, sixth, . . . , n-th display lines are sequentially set into the light emission mode or light extinction mode from one display line to another.

Further, in the addressing stage $W3_1$ of each of the sub-fields SF11 and SF12, discharge cells belonging to each of (4N−3)th display lines (where N is a natural number), i.e., the first, fifth, ninth, . . . , (n−3)th display lines are sequentially set into the light emission mode or light extinction mode from one display line to another. In the addressing stage $W3_2$ of each of the sub-fields SF11 and SF12, discharge cells belonging to each of (4N−2)th display lines (where N is a natural number), i.e., the second, sixth, tenth, . . . , (n−2)th display lines are sequentially set into the light emission mode or light extinction mode from one display line to another. In the addressing stage $W3_3$ of each of the sub-fields SF11 and SF12, discharge cells belonging to each of (4N−1)th display lines (where N is a natural number), i.e., the third, seventh, eleventh, . . . , (n−1)th display lines are sequentially set into the light emission mode or light extinction mode from one display line to another. In the addressing stage $W3_4$ of each of the sub-fields SF11 and SF12, discharge cells belonging to each of (4N)th display lines (where N is a natural number), i.e., the fourth, eighth, twelfth, . . . , n-th display lines are sequentially set into the light emission mode or light extinction mode from one display line to another.

Figure 8:
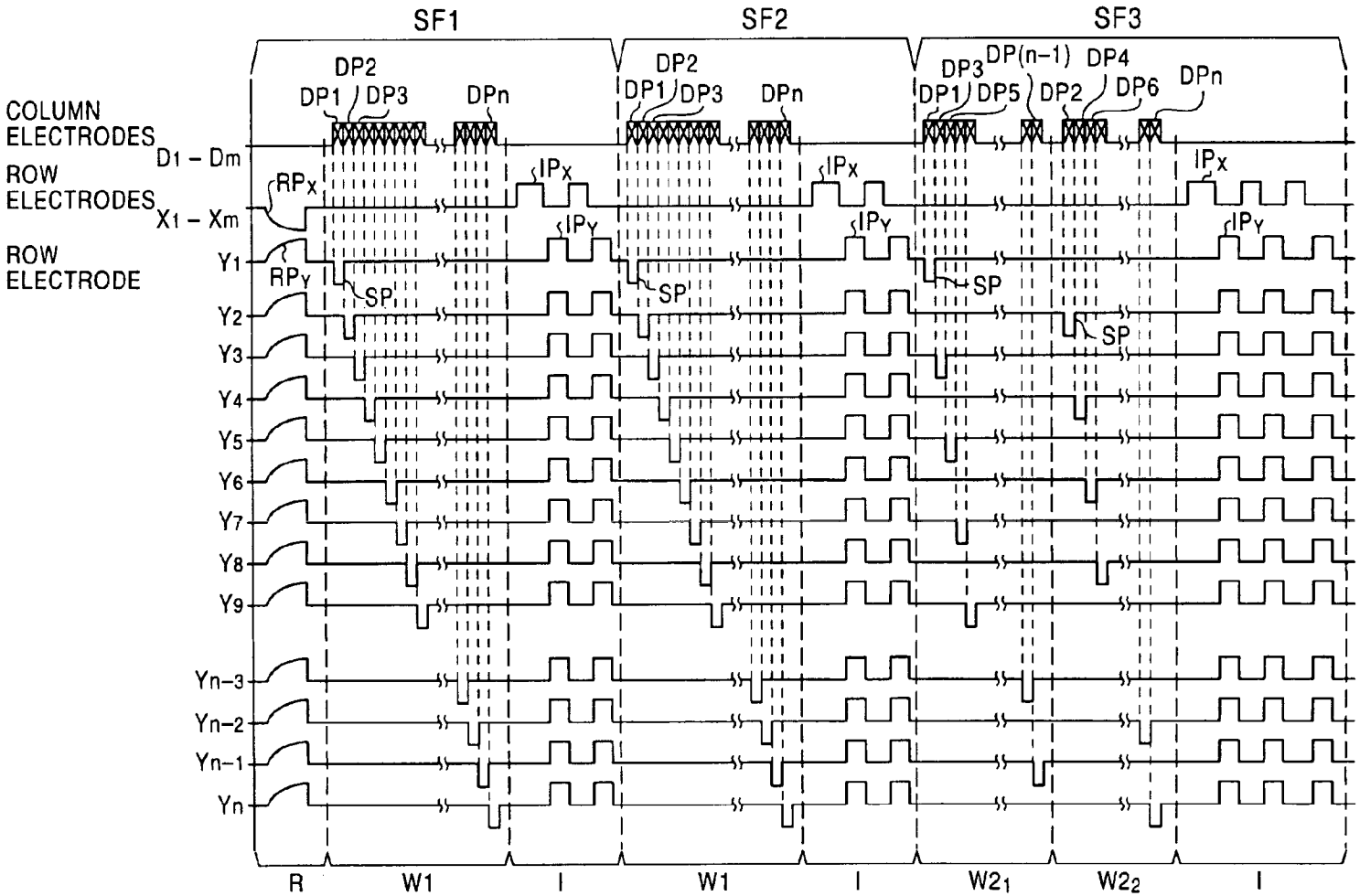
FIG. 8 is a diagram showing a variety of driving pulses applied to a PDP 100 in accordance with the light emission driving sequence shown in FIG. 7, and timings at which the driving pulses are applied.
Figure 9:
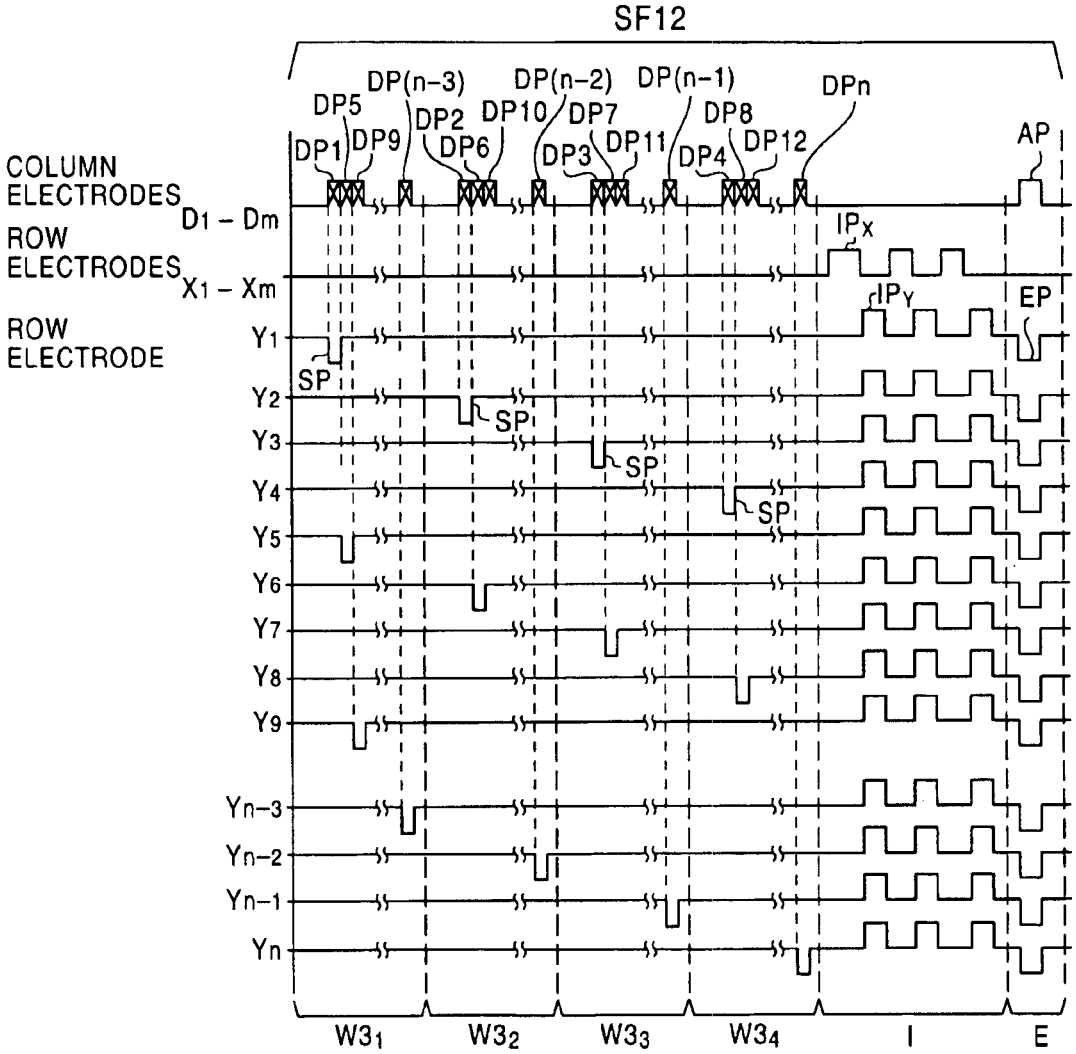
FIG. 9 is a diagram showing a variety of driving pulses applied to a PDP 100 in accordance with the light emission driving sequence shown in FIG. 7, and timings at which the driving pulses are applied.

FIGS. 8 and 9 are diagrams respectively showing a variety of pulses applied to the row electrodes and column electrodes of the PDP 100 by the address driver 6, first sustain driver 7, and second sustain driver 8 in accordance with the light emission driving sequence shown in FIG. 7, and timings at which the pulses are applied. Specifically, FIG. 8 only shows the sub-fields SF1–SF3 extracted from SF1–SF12, while FIG. 9 only shows the sub-field SF12 extracted from SF1–SF12.

First, in the reset stage R of the sub-field SF1 as shown in FIG. 8, the first sustain driver 7 applies the row electrodes $X_1$–$X_n$ with the reset pulse $RP_X$ of negative polarity.

Simultaneously with the application of the reset pulse $RP_X$, the second sustain driver 8 applies the row electrodes $Y_1$–$Y_2$ with the reset pulse $RP_Y$ of positive polarity. In response to the application of these reset pulses $RP_X$ and $RP_Y$, all discharge cells in the PDP 100 are reset or discharged to uniformly form a predetermined amount of wall charge in each of the discharge cells. In this way, all the discharge cells are initialized to a state in which a sustain discharge is generated in the sustain stage I, later described (hereinafter referred to as the "light emission mode").

In the addressing stage W1 of each of the sub-fields SF1 and SF2, the address driver 6 generates a pixel data pulse which has a voltage corresponding to the logical level of a pixel drive data bit DB supplied from the memory 5. For example, the address driver 6 generates a pixel data pulse at high voltage when the pixel drive data bit DB is at logical level "1," and a pixel data pulse at low voltage (zero volt) when the pixel drive data bit DB is at logical level "0." Then, the address driver 6 sequentially applies the column electrodes $D_1$–$D_m$ with the pixel data pulses once for one display line (by m pixel data pulses). For example, in the addressing stage W1 of the sub-field SF1, the address driver 6 first applies the column electrodes $D_1$–$D_m$ with a pixel data pulse group DP1 comprised of m pixel data pulses corresponding to the first display line. Subsequently, the address driver 6 applies the column electrodes $D_1$–$D_m$ with the pixel data pulses once for one display line in the order of a pixel data pulse group DP2 corresponding to the second display line, a pixel data pulse group DP3 corresponding to the third display line, . . . , a pixel data pulse group DPn corresponding to the n-th display line. Further, in the addressing stage W1, the second sustain driver 8 generates a scanning pulse SP of negative polarity as shown in FIG. 8 at the same timing at which each of the pixel data pulse groups DP as mentioned above is applied, and sequentially applies the row electrodes $Y_1$–$Y_n$ with the scanning pulse SP. In this event, discharge is generated only in those discharge cells positioned at intersections of the row electrodes applied with the scanning pulse SP with the column electrodes applied with the pixel data pulse at high voltage (selective erasure discharge), thereby selectively erasing the wall charges which have remained in these discharge cells. The discharge cells which have undergone the selective erasure discharge transition to a state in which the sustain discharge is not generated in the sustain stage I, later described (hereinafter referred to as the "light extinction mode"). On the other hand, discharge cells which do not undergo the selective erasure discharge maintain the previous state. Specifically, discharge cells in the light emission mode maintain the light emission mode without transition, while discharge cells in the light extinction mode maintain the light extinction mode without transition.

As described above, each of discharge cells is set into either the light emission mode or the light extinction mode based on an input video signal from the first display line to the n-th display line on the PDP 100 on a line-by-line basis. In other words, in the addressing stage W1, pixel data is sequentially written from the first display line to the n-th display line on the PDP 100 on a line-by-line basis.

In the addressing stage $W2_1$ of each of the sub-fields SF3–SF10, the address driver 6 sequentially applies the column electrodes $D_1$–$D_m$ with a pixel data pulse group corresponding to each of odd-numbered display lines once for one display line (by six pixel data pulses). For example, in the addressing stage $W2_1$ of the sub-field SF3, the address driver 6 first applies the column electrodes $D_1$–$D_m$ with a pixel data pulse group DP1 comprised of m pixel data pulses corresponding to the first display line of the DPD 100. Subsequently, the address driver 6 sequentially applies the column electrodes $D_1$–$D_m$ with each of pixel data pulse groups DP3, DP5, DP7, . . . , DP(n−1) respectively corresponding to the third, fifth, seventh, . . . , (n−1)th display lines. Further, in the addressing stage $W2_1$, the second sustain driver 8 sequentially applies the odd-numbered row electrodes $Y_1$, $Y_3$, $Y_5$, . . . , $Y_{(n-1)}$ with the scanning pulse SP of negative polarity as shown in FIG. 8 at the same timing at which each of the pixel data pulse groups DP as mentioned above is applied. In this event, the selective erasure discharge occurs only in those discharge cells at the intersections of the row electrodes applied with the scanning pulse SP with the column electrodes applied with the pixel data pulse at high voltage, thereby selectively erasing the wall charges which have remained in these discharge cells. The discharge cells which have undergone the selective erasure discharge transition to the light extinction mode. On the other hand, discharge cells which have not undergone the selective erasure discharge maintain the previous state. Specifically, discharge cells in the light emission mode maintain the light emission mode without transition, while discharge cells in the light extinction mode maintain the light extinction mode without transition.

In the addressing stage $W2_2$ of each of the sub-fields SF3–SF10, the address driver 6 sequentially applies the column electrodes $D_1$–$D_m$ with a pixel data pulse group corresponding to each of even-numbered display lines once for one display line (by six pixel data pulses). For example, in the addressing stage $W2_2$ of the sub-field SF3, the address driver 6 first applies the column electrodes $D_1$–$D_m$ with a pixel data pulse group DP2 comprised of m pixel data pulses corresponding to the second display line of the PDP 100. Subsequently, the address driver 6 sequentially applies the column electrodes $D_1$–$D_m$ with each of pixel data pulse groups DP4, DP6, DP8, . . . , DPn respectively corresponding to the fourth, sixth, eighth, . . . , n-th display lines. Further, in the addressing stage $W2_2$, the second sustain driver 8 sequentially applies the even-numbered row electrodes $Y_2$, $Y_4$, $Y_6$, . . . , $Y_n$ with the scanning pulse SP of negative polarity as shown in FIG. 8 at the same timing at which each of the pixel data pulse groups DP as mentioned above is applied. In this event, the selective erasure discharge occurs only in those discharge cells at the intersections of the row electrodes applied with the scanning pulse SP with the column electrodes applied with the pixel data pulse at high voltage, thereby selectively erasing the wall charges which have remained in these discharge cells. The discharge cells which have undergone the selective erasure discharge transition to the light extinction mode. On the other hand, discharge cells which have not undergone the selective erasure discharge maintain the previous state. Specifically, discharge cells in the light emission mode maintain the light emission mode without transition, while discharge cells in the light extinction mode maintain the light extinction mode without transition.

In this way, in the addressing stage $W2_1$ of each of the sub-fields SF3–SF10, only those discharge cells belonging to the odd-numbered display lines of the PDP 100 are set into either the light emission mode or the light extinction mode based on an input video signal. On the other hand, in the addressing stage $W2_2$, only those discharge cells belonging to the even-numbered display lines are set into either the light emission mode or the light extinction mode based on the input video signal. Specifically, in each of the sub-fields SF3–SF10, pixel data is written into every other display line from the first display line to the n-th display line through the addressing stages $W2_1$ and $W2_2$.

In the addressing stage $W3_1$ of each of the sub-fields SF11 and SF12, the column electrodes $D_1$–$D_m$ are sequentially applied with a pixel data pulse group corresponding to each of the (4N−3)th display lines on the PDP 100 once for one display line (by m pixel data pulses). For example, in the addressing stage $W3_1$ the sub-field SF12 as shown in FIG. 9, the address driver 6 first applies the column electrodes $D_1$–$D_m$ with a pixel data pulse group DP1 comprised of m pixel data pulses corresponding to the first display line on the PDP 100. Subsequently, the address driver 6 sequentially applies the column electrodes $D_1$–$D_m$ with each of pixel data pulse groups DP5, DP9, . . . , DP(n−3) respectively corresponding to the fifth, ninth, . . . , (n−3)th display lines. Further, in the addressing stage $W3_1$, the second sustain driver 8 sequentially applies the (4N−3)th row electrodes $Y_1$, $Y_5$, $Y_9$, . . . , $Y_{(n-3)}$ with the scanning pulse SP of negative polarity as shown in FIG. 9 at the same timing at which each of the pixel data pulse groups DP as mentioned above is applied. In this event, the selective erasure discharge occurs only in those discharge cells at the intersections of the row electrodes applied with the scanning pulse SP with the column electrodes applied with the pixel data pulse at high voltage, thereby selectively erasing the wall charges which have remained in these discharge cells. The discharge cells which have undergone the selective erasure discharge transition to the light extinction mode. On the other hand, discharge cells which have not undergone the selective erasure discharge maintain the previous state. Specifically, discharge cells in the light emission mode maintain the light emission mode without transition, while discharge cells in the light extinction mode maintain the light extinction mode without transition.

In the addressing stage $W3_2$ of each of the sub-fields SF11 and SF12, the column electrodes $D_1$–$D_m$ are sequentially applied with a pixel data pulse group corresponding to each of the (4N−2)th display lines on the PDP 100 once for one display line (by m pixel data pulses). For example, in the addressing stage $W3_2$ of the sub-field SF12 as shown in FIG. 9, the address driver 6 first applies the column electrodes $D_1$–$D_m$ with a pixel data pulse group DP2 comprised of m pixel data pulses corresponding to the second display line on the PDP 100. Subsequently, the address driver 6 sequentially applies the column electrodes $D_1$–$D_m$ with each of pixel data pulse groups DP6, DP10, . . . , DP(n−2) respectively corresponding to the sixth, tenth, . . . , (n−2)th display lines. Further, in the addressing stage $W3_2$, the second sustain driver 8 sequentially applies the (4N−2)th row electrodes $Y_2$, $Y_6$, $Y_{10}$, . . . , $Y_{(n-2)}$ with the scanning pulse SP of negative polarity as shown in FIG. 9 at the same timing at which each of the pixel data pulse groups DP as mentioned above is applied. In this event, the selective erasure discharge occurs only in those discharge cells at the intersections of the row electrodes applied with the scanning pulse SP with the column electrodes applied with the pixel data pulse at high voltage, thereby selectively erasing the wall charges which have remained in these discharge cells. The discharge cells which have undergone the selective erasure discharge transition to the light extinction mode. On the other hand, discharge cells which have not undergone the selective erasure discharge maintain the previous state. Specifically, discharge cells in the light emission mode maintain the light emission mode without transition, while discharge cells in the light extinction mode maintain the light extinction mode without transition.

In the addressing stage $W3_3$ of each of the sub-fields SF11 and SF12, the column electrodes $D_1$–$D_m$ are sequentially applied with a pixel data pulse group corresponding to each of the (4N−1)th display lines on the PDP 100 once for one display line (by m pixel data pulses). For example, in the addressing stage $W3_3$ of the sub-field SF12 as shown in FIG. 9, the address driver 6 first applies the column electrodes $D_1$–$D_m$ with a pixel data pulse group DP3 comprised of m pixel data pulses corresponding to the third display line on the PDP 100. Subsequently, the address driver 6 sequentially applies the column electrodes $D_1$–$D_m$ with each of pixel data pulse groups DP7, DP11, . . . , DP(n−1) respectively corresponding to the seventh, eleventh, (n−1)th display lines. Further, in the addressing stage $W3_3$, the second sustain driver 8 sequentially applies the (4N−1)th row electrodes $Y_3$, $Y_7$, $Y_{11}$, . . . , $Y_{(n-1)}$ with the scanning pulse SP of negative polarity as shown in FIG. 9 at the same timing at which each of the pixel data pulse groups DP as mentioned above is applied. In this event, the selective erasure discharge occurs only in those discharge cells at the intersections of the row electrodes applied with the scanning pulse SP with the column electrodes applied with the pixel data pulse at high voltage, thereby selectively erasing the wall charges which have remained in these discharge cells. The discharge cells which have undergone the selective erasure discharge transition to the light extinction mode. On the other hand, discharge cells which have not undergone the selective erasure discharge maintain the previous state. Specifically, discharge cells in the light emission mode maintain the light emission mode without transition, while discharge cells in the light extinction mode maintain the light extinction mode without transition.

In the addressing stage $W3_4$ of each of the sub-fields SF11 and SF12, the column electrodes $D_1$–$D_m$ are sequentially applied with a pixel data pulse group corresponding to each of the (4N)th display lines on the PDP 100 once for one display line (by m pixel data pulses). For example, in the addressing stage $W3_4$ of the sub-field SF12 as shown in FIG. 9, the address driver 6 first applies the column electrodes $D_1$–$D_m$ with a pixel data pulse group DP4 comprised of m pixel data pulses corresponding to the fourth display line on the PDP 100. Subsequently, the address driver 6 sequentially applies the column electrodes $D_1$–$D_m$ with each of pixel data pulse groups DP8, DP12, DP(n) respectively corresponding to the eighth, twelfth, . . . , n-th display lines. Further, in the addressing stage $W3_4$, the second sustain driver 8 sequentially applies the (4N)th row electrodes $Y_4$, $Y_8$, $Y_{12}$, . . . , $Y_{(n)}$ with the scanning pulse SP of negative polarity as shown in FIG. 9 at the same timing at which each of the pixel data pulse groups DP as mentioned above is applied. In this event, the selective erasure discharge occurs only in those discharge cells at the intersections of the row electrodes applied with the scanning pulse SP with the column electrodes applied with the pixel data pulse at high voltage, thereby selectively erasing the wall charges which have remained in these discharge cells. The discharge cells which have undergone the selective erasure discharge transition to the light extinction mode. On the other hand, discharge cells which have not undergone the selective erasure discharge maintain the previous state. Specifically, discharge cells in the light emission mode maintain the light emission mode without transition, while discharge cells in the light extinction mode maintain the light extinction mode without transition.

As described above, in the addressing stage $W3_1$ of each of the sub-fields SF11 and SF12, only discharge cells belonging to the (4N−3)th display lines on the PDP 100 are set into either the light emission mode or the light extinction mode based on an input video signal. In the addressing stage $W3_2$, in turn, only discharge cells belonging to the (4N−2)th display lines on the PDP 100 are set into either the light emission mode or the light extinction mode based on the input video signal. Also, in the addressing stage $W3_3$, only discharge cells belonging to the (4N−1)th display lines on the PDP 100 are set into either the light emission mode or the light extinction mode based on the input video signal. Further, in the addressing stage $W3_4$, only discharge cells belonging to the (4N)th display lines on the PDP 100 are set into either the light emission mode or the light extinction mode based on the input video signal. In other words, in the sub-fields SF11 and SF12, pixel data is written into every third display line from the first display line to the n-th display line through the addressing stages $W3_1$–$W3_4$. Next, in the sustain stage I of each sub-field, the first sustain driver 7 and second sustain driver 8 alternately and repeatedly apply the row electrodes $X_1$–$X_n$ and $Y_1$–$Y_n$ with sustain pulses $IP_X$ and $IP_Y$ as shown in FIG. 8 or 9. In this event, the number of times the sustain pulses $IP_X$, $IP_Y$ are applied in the sustain stage I of each of the sub-fields SF1–SF12 corresponds to a light emission duration assigned to each of the sub-fields, as previously described.

In this event, only discharge cells in which the wall charge still remains, i.e., discharge cells remaining in the light emission mode discharge to sustain the light emission mode each time they are applied with the sustain pulses $IP_X$ and $IP_Y$. Consequently, the discharge cells in the light emission mode sustain the light emission associated with the sustain discharge for a light emission duration allocated to each sub-field.

In the erasure stage E performed only in the last sub-field SF12, the address driver 6 generates an erasure pulse AP of positive polarity as shown in FIG. 9 which is applied to the column electrodes $D_1$–$D_m$. Further, the second sustain driver 8 generates an erasure pulse EP of negative polarity as shown in FIG. 9 simultaneously with the timing at which the erasure pulse AP is applied, and applies the erasure pulse EP to each of the row electrodes $Y_1$–$Y_n$. The simultaneous application of the erasure pulses AP and EP causes an erasure discharge to occur in all the discharge cells within the PDP 100, resulting in extinction of the wall charges remaining in all the discharge cells.

According to the driving sequence shown in FIGS. 7–9, only discharge cells set in the light emission mode in the addressing stage W of each sub-field repeat the light emission associated with the sustain discharge in the immediately following sustain stage I.

Here, whether each discharge cell is set into the light emission mode or the light extinction mode depends on the pixel drive data GD as shown in FIG. 6. Specifically, when each bit of the pixel drive data GD is at logical level "1," the selective erasure discharge (represented by a black circle) is generated in the addressing stage Wc in the sub-field corresponding to the bit digit, thereby setting the discharge cell into the light extinction mode. On the other hand, when the bit is at logical level "0," the selective erasure discharge is not generated, so that the discharge cell maintains the current state. Specifically, a discharge cell which has remained in the light emission mode immediately before the addressing stage W maintains the light emission mode, while a discharge cell which has remained in the light extinction mode maintains the light extinction mode. In this event, according to the 13 possible pixel drive data GD as shown in FIG. 6, the number of bits which are at logical level "1" is one at most within the first to twelfth bits. In other words, according to the pixel drive data GD shown in FIG. 6, the selective erasure discharge is generated once or less without fail in one field period. Further, according to the light emission driving sequence shown in FIG. 7, discharge cells can be set into the light emission mode only in the simultaneous reset stage R in the first sub-field SF1. Therefore, when the PDP 100 is driven in accordance with the light emission driving sequence shown in FIG. 7 using the pixel drive data GD shown in FIG. 6, each discharge cell continuously remains in the light emission mode from the beginning of each field until the selective erasure discharge is generated in the sub-field marked with a black circle in FIG. 6. Then, the light emission is repeated associated with the sustain discharge for a duration corresponding to each sub-field in the sustain stage I of each of sub-fields represented by white circles existing in between. In this event, a halftone luminance is viewed in accordance with the total number of times of light emission associated with the sustain discharge performed in each of the sub-fields SF1–SF12 within one field period. Specifically, the 13 different values of pixel drive data GD as shown in FIG. 6 provide representations of 13 intermediate luminance levels respectively having the following light emission luminance:

[0:2:5:8:18:29:46:68:96:131:174:225:255]

Here, the power consumed in the addressing stages (W1, $W2_1$, $W2_2$, $W3_1$–$W3_4$) (hereinafter referred to as the "addressing power") increases as the discharge cells are switched from the light emission mode to the light extinction mode or from the light extinction mode to the light emission mode on each column electrode D a larger number of times (per unit time). For example, for sequentially setting each discharge cell into the light emission mode (represented by a white circle) or into the light extinction mode (represented by a black circle) in a form shown in FIG. 10 from the first to the n-th display lines on a line-by-line basis, the discharge cells are switched from the light emission mode to the light extinction mode (or vice versa) on each column electrode D from one display line to another. Specifically, discharge cells on the first display line are first set into the light extinction mode; discharge cells on the second display line into the light emission mode; discharge cells on the third display line into the light extinction mode; and discharge cells on the fourth display line into the light emission mode. Now, focusing only on a column electrode $D_1$, the column electrode $D_1$ is applied with a pixel data pulse at high voltage for setting the discharge cells on the first and third display lines into the light extinction mode, whereas the column electrode $D_1$ is applied with a pixel data pulse at low voltage for setting the discharge cells on the second and fourth display lines into the light emission mode. In this event, due to the PDP 100 comprised of capacitive light emission elements, as the column electrode $D_1$ is applied with a pixel data pulse at high voltage for setting the discharge cells on the first display line into the light extinction mode, a load capacitance of the PDP 100 is charged in response to the applied pixel data pulse. Next, as the column electrode $D_1$ is applied with a pixel data pulse at low voltage for setting the discharge cells on the second display line into the light emission mode, the charge accumulated by the foregoing charging is discharged. Likewise, as the column electrode $D_1$ is next applied with a pixel data pulse at low voltage for setting the discharge cells on the third display line into the light extinction mode, the load capacitance of the PDP 100 is again charged. In other words, the load capacitance of the PDP 100 is charged each time the light emission mode setting for setting each discharge cell into the light emission mode is switched into the light extinction mode setting for setting each discharge cell into the light extinction mode, thereby consuming useless power due to the charging.

To prevent the wasteful charging, in the present invention, pixel data is written into every other display lines from the first display line to the n-th display line on the PDP 100 in the addressing stages $W2_1$ and $W2_2$ of each of the sub-fields SF3–SF10. For example, for writing pixel data into each discharge cell in a form as shown in FIG. 10, the discharge cells belonging to each of the first, third, fifth, . . . , (n−1)th display lines are first set into the light extinction mode from one display line to another in the addressing stage $W2_1$. In this vent, the column electrode $D_1$ is applied with a pixel data pulse at high voltage for setting the discharge cells into the light extinction mode. In response to the application of the pixel data pulse at high voltage, the load capacitance of the PDP 100 is charged when pixel data is written into the first display line. However, the load capacitance of the PDP 100 is not charged when pixel data is next written into the third display line because the load capacitance has already been charged. Likewise, such charging is avoided as well in the operation for the fifth display line onward. In the addressing stage $W2_2$, in turn, discharge cells belonging to each of the second, fourth, sixth, . . . , n-th display lines are set into the light emission mode from one display line to another. In this event, the column electrode $D_1$ is applied with a pixel data pulse at low voltage for setting the discharge cells into the light emission mode. However, the load capacitance of the PDP 100 is not charged even if the column electrode $D_1$ is applied with a low voltage pixel data pulse.

In the foregoing way, pixel data is written into each discharge cell every other display line in the addressing stages $W2_1$ and $W2_2$ of each of the sub-fields SF3–SF10. Therefore, for setting each discharge cell in the form as shown in FIG. 10, discharge cells are successively set into the light emission mode (or the light extinction mode) on each column electrode. This results in a smaller number of times the light emission mode setting is switch to the light extinction mode setting (per unit time), leading to a reduced number of times the load capacitance of the PDP 100 is charged, and to limitations to wasteful power consumption for the charging.

Nevertheless, for setting each discharge cell in a form as shown in FIG. 11, the light emission mode setting is frequently switched to the light extinction mode setting on each column electrode D in the addressing stages ($W2_1$, $W2_2$) of each of the sub-fields SF3–SF10. In this event, however, the light emission mode setting is switched to the light extinction mode setting in the addressing stage W1 of each of the sub-fields SF1 and SF2 a number of times half as much as that in the addressing stages $W2_1$ and $W2_2$ (per unit time). This results in a reduced number of times the load capacitance is charged, leading to limitations to the wasteful power consumption for the charging. Further, in the addressing stages $W3_1$–$W3_4$ of each of the sub-fields SF11 and SF12, pixel data is written into each discharge cell every fourth display line. Consequently, the light emission mode setting is switched to the light extinction mode setting on each column electrode a number of times (per unit time) largely reduced as compared with those in the addressing stages $W2_1$ and $W2_2$. This results in a reduced number of times the load capacitance is charged, leading to limitations to the wasteful power consumption for the charging.

As described above, in the display device shown in FIG. 3, the discharge cells belonging to each of the first to the n-th display lines on the PDP 100 are sequentially scanned from one display line to another to set them into either the light emission mode or the light extinction mode in the addressing stage W1 of each of the sub-fields SF1 and SF2. In the addressing stages $W2_1$ and $W2_2$ of each of the sub-fields SF3–SF10, the discharge cells belonging to each of the first to the n-th display lines of the PDP 100 are scanned every other display line to set them into either the light emission mode or the light extinction mode. Then, in the addressing stages ($W3_1$, $W3_2$, $W3_3$, $W3_4$) of each of the sub-fields SF11 and SF12, the discharge cells belonging to each of the first to the n-th display lines of the PDP 100 are scanned every fourth display line to set them into either the light emission mode or the light extinction mode. Stated another way, in a sub-field group consisting of SF1 and SF2, in a sub-field group consisting of SF3–SF10, and in a sub-field group consisting of SF11 and SF12, the discharge cells are scanned from one display line to another in different orders.

This results in a less number of times the discharge cells are switched from the light emission mode to the light extinction mode on each column electrode, and a resulting reduction in the number of times the load capacitance of the display panel is charged, leading to limitations to wasteful power consumption spent for the charging.

While the foregoing embodiment has given an exemplary display device equipped with a plasma display panel as a display panel for describing the driving method according to the present invention, the present invention can be applied as well to a display device equipped with an electroluminescence panel as long as it is a capacitive display panel.

In essence, for scanning pixel cells of a capacitive display panel from one display line to another to set the pixel cells into the light emission mode or the light extinction mode in the addressing stage of each sub-field in one field, the display lines may be scanned in different orders from one sub-field to another or from one sub-field group to another.

Alternatively, in FIG. 7, the sustain stage in a sub-field which involves a large number of times of light emission may be divided into a plurality of divided sustain stages, and each of these divided sustain stages may be performed immediately after each addressing stage of the sub-field. For example, the sustain stage I of the sub-field SF11, which is allocated a light emission duration "47" as shown in FIG. 7, may be divided into sustain stages $I_1$–$I_3$, each of which is allocated a light emission duration "12," and a sustain stage $I_4$ which is allocated a light emission duration "11." Then, in the sub-field SF11, the PDP 100 is driven in the order of the addressing stage $W3_1$, sustain stage $I_1$, addressing stage $W3_2$, sustain stage $I_2$, addressing stage $W3_3$, sustain stage $I_3$, addressing stage $W3_4$, and sustain stage $I_4$.

While each field is divided into 12 sub-fields SF1–SF12 as shown in FIG. 7 for driving in the foregoing embodiment, the number of sub-fields into which one field is divided is not limited to 12. Also, in the embodiment shown in FIG. 7, the addressing stage $W_1$ is performed in SF1 and SF2; the addressing stages $W2_1$ and $W2_2$ in SF3–SF10; and addressing stages $W3_1$, $W3_2$, $W3_3$, $W3_4$ in SF11 and SF12, but the present invention is not limited to this driving sequence.

Figure 12:
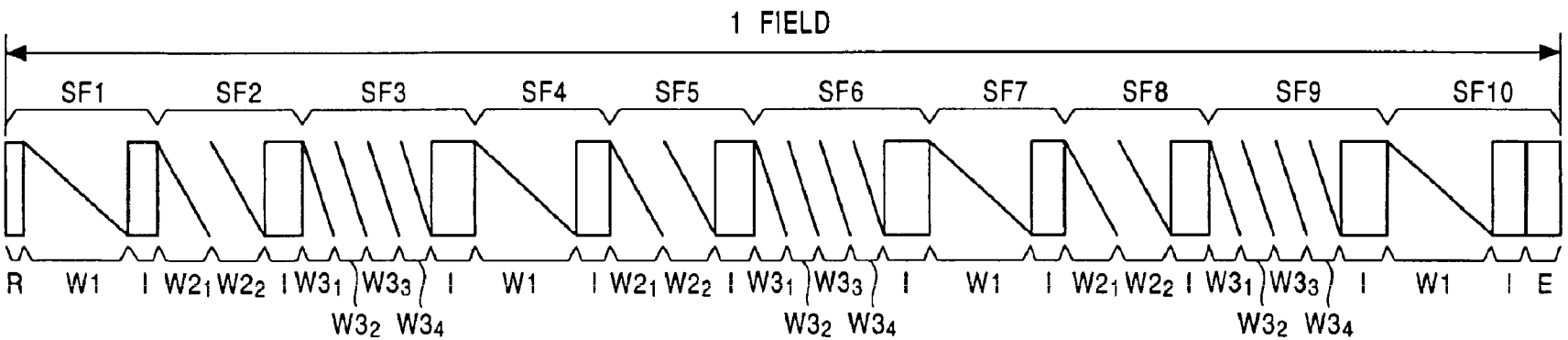
FIG. 12 is a diagram showing another example of the light emission driving sequence in the display device shown in FIG. 3.

For example, as shown in FIG. 12, each field may be comprised of ten sub-fields SF1–SF10. In the sub-fields SF1, SF4, SF7, and SF10, the addressing stage W1 is performed to sequentially scan the discharge cells belonging to each of the first to the n-th display lines from one display line to another to set the discharge cells into either the light emission mode or the light extinction mode. In the sub-fields SF2, SF5, and SF8, the addressing stages $W2_1$ and $W2_2$ are performed to scan the discharge cells belonging to each of the first to the n-th display lines every other display line to set the discharge cells into either the light emission mode or the light extinction mode. Then, in the sub-fields SF3, SF6, and SF9, the addressing stages $W3_1$, $W3_2$, $W3_3$, and $W3_4$ are performed to scan the discharge cells belonging to each of the first to the n-th display lines every fourth display line to set the discharge cells into either the light emission mode or the light extinction mode.

Also, while the addressing stages W1, $W2_1$, $W2_2$, $W3_1$, $W3_2$, $W3_3$, and $W3_4$ are mixedly performed in each field, they may be performed in units of fields.

Figure 13:
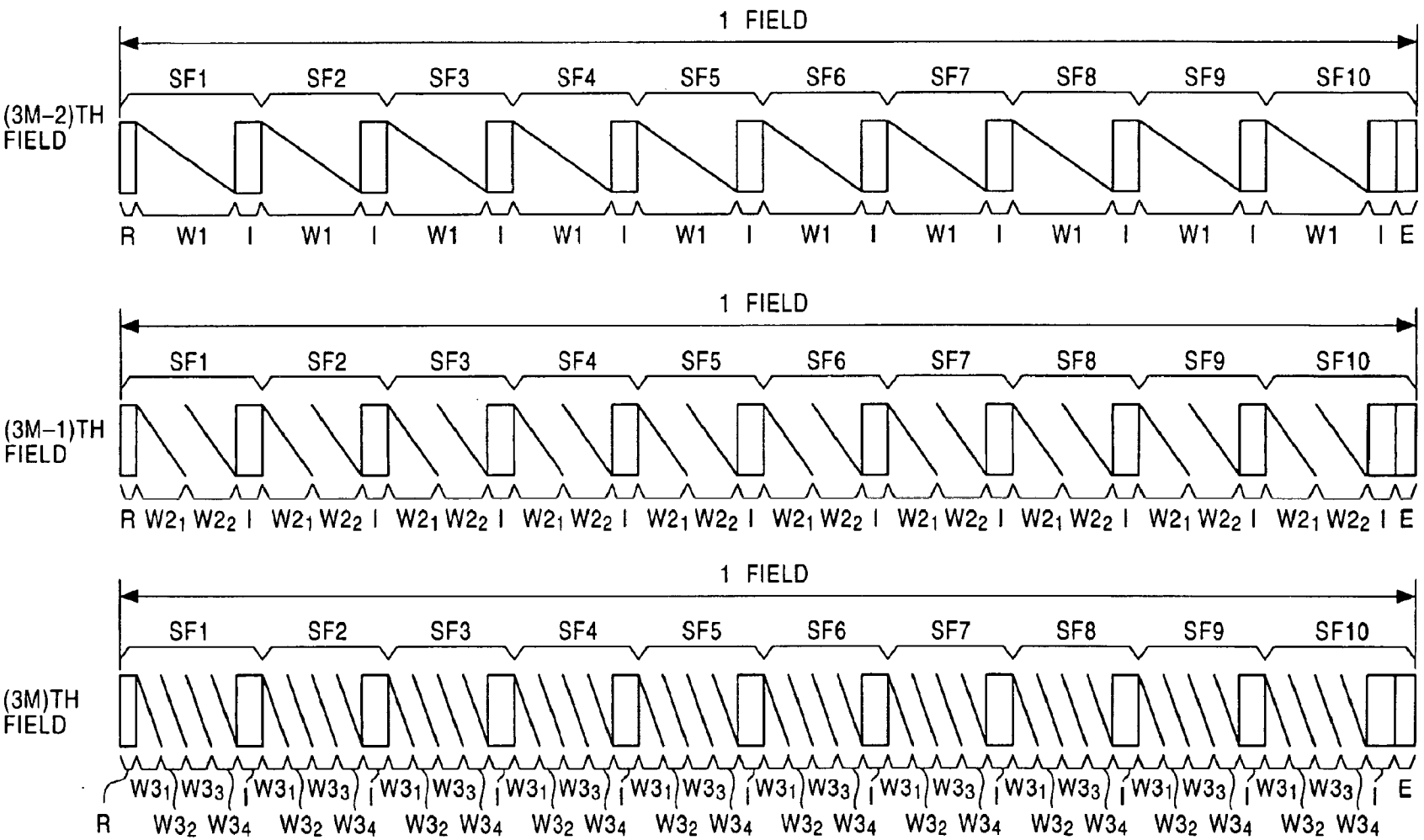
FIG. 13 is a diagram showing a further example of the light emission driving sequence in the display device shown in FIG. 3.

For example, as shown in FIG. 13, in a (3M−2)th field (M is a natural number) such as the first field, fourth field, and seventh field in an input video signal, the addressing stage W1 is performed in each sub-field of this field. Also, in a (3M−1)th field such as the second field, fifth field, and eighth field, the addressing stages $W2_1$ and $W2_2$ are preformed in each sub-field of this field. Then, in a (3M)th field such as the third field, sixth field, and ninth field, the addressing stages $W3_1$, $W3_2$, $W3_3$, and $W3_4$ are performed in each sub-field of this field.

In essence, the first to the n-th display lines are scanned in the addressing stage in a field or in a field group comprised of a plurality of fields in an order different from those in the addressing stages in other fields or in other field groups.

This application is based on Japanese Patent Applications Nos. 2003-113651 and 2003-180709 which are herein incorporated by reference.

What is claimed is:

1. A display panel driving method for driving a display panel formed with a plurality of pixel cells serving as pixels on each of n display lines every plural sub-fields which make up each field of an input video signal for providing a gradation display, wherein: each of said sub-field includes:

an addressing stage for scanning each of pixel cells formed on each of said n display lines from one display line to another to set said pixel cells into either a light emission mode or a light extinction mode based on the input video signal, and a sustain stage for forcing only said pixel cells set in the light emission mode to emit light for a duration corresponding to said sub-field; and wherein a set of scanning modes including a progressive scanning mode and a plurality of interlaced scanning modes which respectively have different numbers of skipping lines is prepared, and a scanning mode is changed from one of said set of scanning modes to another one of said set of scanning modes at intervals of a subfield or a subfield group.

2. A display panel driving method according to claim 1, wherein each of said n display lines is sequentially scanned one by one in said addressing stage in each of at least two sub-fields in each of said sub-fields, while each of said n display line is scanned at intervals of k display lines (k is a natural number) in said addressing stage in each of the other sub-fields.

3. A display panel driving method for driving a display panel formed with a plurality of pixel cells serving as pixels on each of n display lines in accordance with an input video signal for providing a gradation display, said method comprising the step of:

performing an addressing stage for scanning each of said pixel cells formed on each of said n display lines from one display line to another to set said pixel cell into a light emission mode or a light extinction mode based on the input video signal, and a sustain stage for forcing only said pixel cells set in the light emission mode to emit light for a duration corresponding to a sub-field, wherein a set of scanning modes including a progressive scanning mode and a plurality of interlaced scanning modes which respectively have different numbers of skipping lines is prepared, and a scanning mode is changed from one of said set of scanning modes to another one of said set of scanning modes at intervals of a subfield or a subfield group.

* * * * *

UNITED STATES PATENT AND TRADEMARK OFFICE

CERTIFICATE OF CORRECTION

PATENT NO. : 7,053,872 B2
APPLICATION NO. : 10/801638
DATED : May 30, 2006
INVENTOR(S) : Takashi Iwami It is certified that error appears in the above-identified patent and that said Letters Patent is hereby corrected as shown below:

Col. 16, line 45, delete “subfield”, insert --field--

Col. 16, line 46, delete “subfield”, insert --field--

Signed and Sealed this

Twenty-second Day of May, 2007

JON W. DUDAS
*Director of the United States Patent and Trademark Office*